US005723844A

United States Patent [19]

Dow et al.

[11] Patent Number: 5,723,844

[45] Date of Patent: Mar. 3, 1998

[54] HEATING SYSTEM USING FERRITE TO CONVERT RF ENERGY INTO HEAT ENERGY

[76] Inventors: Robert L. Dow, 9674 Charles St., LaPlata, Md. 20646; Paul W. Proctor, Rte. 2, Kathy La., White Plains, Md. 20695

[21] Appl. No.: 634,525

[22] Filed: Apr. 18, 1996

Related U.S. Application Data

[63] Continuation of Ser. No. 287,293, Aug. 8, 1994, abandoned.

[51] Int. Cl.[6] ..... H05B 6/10

[52] U.S. Cl. ..... 219/618; 219/634; 219/635; 219/759; 166/60; 166/248

[58] Field of Search ..... 219/618, 634, 219/660, 635, 759; 166/60, 248

[56] References Cited

U.S. PATENT DOCUMENTS 3,902,940 9/1975 Heller .
4,355,222 10/1982 Geithman et al. ..... 252/635
4,807,620 2/1989 Strul et al. ..... 128/303.1
5,120,604 6/1992 Nakamura ..... 252/62.56
5,126,521 6/1992 McGaffigan .
5,128,504 7/1992 McGaffigan .
5,182,427 1/1993 McGaffigan .
5,189,271 2/1993 Derbyshire .
5,197,468 3/1993 Proctor et al. ..... 128/419 PG
5,208,443 5/1993 McGaffigan .
5,279,225 1/1994 Dow .

*Primary Examiner*—Philip H. Leung
*Attorney, Agent, or Firm*—Terry M. Gernstein

[57] ABSTRACT

A system for using a ferrite element to convert RF energy into heat consists only of the ferrite element, an RF generator and a cable connecting the ferrite element to the RF generator. No external impedance matching mechanism is needed, and the preferred form of the ferrite has a Curie temperature in excess of 150° C., and has a lower cutoff frequency of about 10 KHz. The specific best mode ferrite element includes a formulation of $MnO_{0.45}Zn_{0.3}FeO_{0.25}Fe_2O_4$. One use of the circuit is in the mining industry.

11 Claims, 3 Drawing Sheets

FIG. 1.
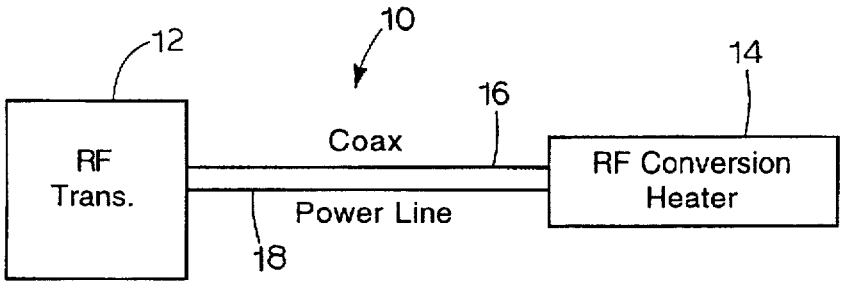
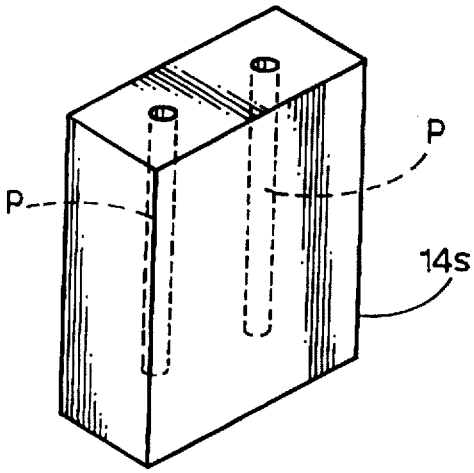
FIG. 2.
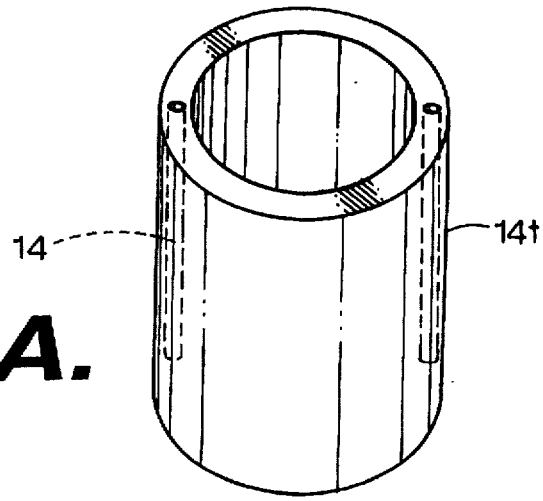
FIG. 2A.

HEATING SYSTEM USING FERRITE TO CONVERT RF ENERGY INTO HEAT ENERGY

This is a continuation of application Ser. No. 08/287,293, filed on Aug. 8, 1994, now abandoned.

TECHNICAL FIELD OF THE INVENTION

The present invention relates to the general art of heating systems, and to the particular field of heating systems that use RF energy, and can transfer heat energy to remote locations.

BACKGROUND OF THE INVENTION

Many industries, including the mining industry, oil recovery industry, and the chemical industry, require the controlled application of heat to various elements and/or locations. For example, the mining of some solids, such as sulfur, often includes a step of liquefying that product and moving the liquid to a suitable location for recovery. Enhanced oil recover also often includes a step in which a solid is liquified for transport.

Many industries also require the generation and movement of steam. For example, steam injection can also be used in geological formations for several purposes. Steam that has been converted to water in geological formations must be disposed of in an economical and environmentally acceptable manner. There are millions of gallons of trapped contaminated brine that cannot be reused or reheated with current heating technologies, or even brought to the surface for environmentally safe disposal because there is no cost-effective disposal method for the contaminated brines. Still further, there are huge spent energy resources remaining in previously worked Frasch sulfur domes that can't be recovered since there is no practical method to add energy to the spent brine.

The prior heater art has included many techniques and systems for using controlled amounts of heat to carry out liquefication. Such techniques have included pumping steam to a site of application, with the steam being generated using resistive heaters, and direct fired steam generators.

Some heater systems include a ferrite element. The use of ferrite as a heat transfer element has many advantages, including the chemical inertness thereof.

Therefore, the art has included devices which use ferrite heat transfer elements to transfer heat to a location or to another element. For example, the art includes devices such as disclosed in U.S. Pat. 5,182,427, which includes a ferrite elements operated at its Curie temperature to apply heat to a specific element at a specific location. Still other systems use ferrite elements to control the maximum temperature produced by a device.

While effective, present techniques and systems using a ferrite element to transfer heat require some form of external regulation to operate in a controlled manner. The regulation is often required to control the maximum temperature attained by the ferrite element. If the temperature of the ferrite elements is too high, or significantly exceeds the Curie temperature, the viability and even the integrity, of the overall system may be compromised.

The external controls often take the form of some external regulation such as a control circuit, or a requirement that the system operate at the Curie temperature of the ferrite element. Any requirement for external control places limitations on the heating system and may detract from the overall adaptability of the system as well as adversely affecting the cost and heating efficiency.

Therefore, there is a need for a heating system that uses ferrite as a heat transfer element, yet does not require external control systems to efficiently and effectively transfer heat to a specific location and/or element.

OBJECTS OF THE INVENTION

It is a main object of the present invention to provide a heating system that includes a heating element that retains the advantages associated with ferrite heat transfer elements.

It is another object of the present invention to provide a heating system that includes a heating element that retains the advantages associated with ferrite heat transfer elements but does so without requiring external control systems.

It is another object of the present invention to provide a heating system that includes a heating element that can be placed in an accurate and precise manner.

It is another object of the present invention to provide a heating system that includes a heating element that can be placed in an underground or enclosed area and will still efficiently transfer heat.

It is a specific object of the present invention to provide a heating system that can be used in the mining industry.

It is another object of the present invention to provide a heating system that can be used in high temperature catalyst bed applications for chemical process industry applications.

It is another object of the present invention to provide heat efficiently to reactivate previously abandoned Frasch Sulfur deposits.

It is another object of the present invention to directly heat brine already trapped in geologic formulations thereby eliminating the need to inject additional high pressure, high temperature steam previously required to reinvigorate underground mining operations.

It is another object of the present invention to greatly simplify previous art attempts to use ferrite elements for all heating applications.

It is another object of the present invention to use ambient pressure methods to transfer energy to geologic formulations that previously required high pressure, and high temperature steam lines and associated equipment to accomplish the same heat transfer.

It is another object of the present invention to heat a wide variety of liquefiable and recoverable solids underground with the same basic heater system.

It is another object of the present invention to heat remotely located substances more efficiently than is now practical.

It is another object of the present invention to control the temperature of pipelines and recovery pipes in oil wells to prevent the formulation of solids that decrease flow and increase pumping costs.

It is another object of the present invention to provide a practical method for melting liquefiable solids in transport containers.

It is another object of the present invention to provide an alternative more practical method for melting ice at construction sites to extend the length of the construction season.

It is another object of the present invention to provide an alternate method to use RF energy to melt liquefiable material by means other than transmitting RF energy into the substance.

It is another object of the present invention to provide a control method for conducting chemical reactions at precise, high temperatures.

It is another object of the present invention to supply energy to control endothermic chemical reactions.

It is another object of the present invention to provide a high controlled temperature, chemically inert high pressure reaction vessel.

SUMMARY OF THE INVENTION

These, and other, objects are achieved by a heating system that includes a heating device formed of lossy, soft ferrite, having a high Curie temperature as a heater body and an RF generator connected to the ferrite heating device by a coaxial cable as the only elements in the heating system. The system is exclusive of other elements. No external RF tuning circuit is required. Specifically, the ferrite heating device has a Curie temperature above 150° C. and as high as 400° C. and preferably between 250° C. and 280° C., and has a lower cutoff frequency about 10 KHz. Therefore, as used herein, the term "high Curie temperature" means a Curie temperature of above 150° C., and as high as 400° C. and preferably is in the range of 250° C. and 280° C. Most specifically, an example of the type of ferrite used in the heater body is found in U.S. Pat. 5,279,225, the disclosure of which is incorporated herein by reference. As disclosed in the referenced patent, the ferrite has an analysis that corresponds to $MnO_{0.45}Zn_{0.3}FeO_{0.25}Fe_2O_4$. Currently, ferrite meeting the requirements set forth above is sold by Attenuation Technology, Inc. under the registered trademark MN-68.

The ferrite element of the present invention converts RF energy directly to heat and this heat is used in a controlled manner rather than dissipated as is the case with other devices. The only components in a circuit are the ferrite element, the RF generator and the cable connecting those two elements. There is no control circuit or external impedance matching circuit required. This greatly simplifies the construction and produces a system that is tough, rugged and survives adverse environments and is low cost.

The high Curie temperature ferrite element of the present invention absorbs RF energy more efficiently as its temperature increases, and can reach very high temperatures without exceeding its Curie temperature by transferring the converted RF energy directly to material in contact with the heater. The ferrite element of the present invention does the required tuning automatically as a characteristic of the Ferrite formulation and associated structure of MN-68 as it first starts to heat due to the conversion of RF energy directly into heat by the ferrite formulation. The RF absorption effect of the selected ferrite formulation is further enhanced once the ferrite heater device is surrounded by a melted dielectric material created when many liquefiable solids melt. Therefore, this ferrite can be used for all applications requiring a high temperature difference ($\Delta T$). This ferrite is especially useful in applications in which a great deal of heat is to be transferred to a heat sink associated with the ferrite device. Most specifically, the ferrite element is useful in many underground mining operations. The ferrite heating element can be used in many high temperature catalyst beds.

Using the MN-68 ferrite as the heating element eliminates the need for an external impedance matching mechanism for successful heat generation by the system. Because of the ferrite formulation of MN-68, external impedance matching mechanisms are not required. MN-68 ferrite appears to become more lossy as the ferrite device heats up. When the ferrite device is cold, there is a small reflected RF signal. As the ferrite device heats up, the reflected RF signal is no longer present. Further, RF power transmitted to the MN-68 ferrite can be increased as the temperature increases. All applications of the MN-68 ferrite use maximum ($\Delta T$), and maximum safe RF power level to achieve maximum heat transfer efficiency. The high Curie Temperature of MN-68 ferrite permits this. Therefore, no external impedance matching circuit is required. Eliminating the external impedance matching mechanisms also lowers the unit cost, increases the heating efficiency and makes the system embodying the present invention more suitable for field applications where the use of impedance matching systems and elements may not be feasible or practical. Because of the inert chemical characteristics of ferrite heater device, it can be safely placed next to, or submerged in, many different materials to be heated or melted, and can safely be submerged in many caustic, scaling or corrosive materials. Due to the inert chemical characteristics of ferrite, the element to be heated can be placed in direct contact with the ferrite heating element to increase heat transfer efficiency thereby further enhancing the desirable characteristics of the system of the present invention.

While the MN-68 ferrite is disclosed herein for use in a mining operation, the system using MN-68 ferrite can be used in many other applications as well, as will be discussed below. Mining is simply the best mode application.

The heater system of the present invention provides a practical method, with low cost equipment, that is energy efficient and, for example, does not require the use of any additional fresh water for generating steam in various geological locations. Since the system does not use water as the energy carrier, there is no additional brine that will require an environmentally acceptable disposal method.

In another application of the present system, the heater element is simply lowered into the lowest elevation of a sulfur deposit and RF energy applied. Applying the energy to the exact point needed will start melting new areas of the sulfur deposit previously missed by prior steam injection methods and will stimulate the old sulfur dome into new production.

With the system of the present invention, the RF generator is positioned above ground, coax cable is run down a supply pipe (at ambient temperature and pressure compared to high pressure, high temperature injected steam) and, if necessary, can be encased in a stainless steel jacket to protect it from damage and corrosion to a ferrite heater located directly in the formation of interest. The supply pipe can act as the stainless steel jacket if suitable. Only at that point is the RF energy converted directly to heat, greatly minimizing all of the energy losses and capital expenses associated with prior art steam injection methods.

The ferrite heater element can run nearly indefinitely very near its Curie temperature in a corrosive environment without corrosion or performance deterioration. If brine salts do build up on the ferrite heater element, these deposits can be cracked off by turning off the RF power thus contracting the element. After returning to ambient temperature, the RF power is turned back on. This temperature shock breaks the salt deposition free from the ferrite heater element without detectable damage or degradation to the ferrite heating element.

Because the ferrite heater element can be positioned in any suitable location and will deliver heat in an efficient manner, any procedure that requires the precise and accurate transfer of heat can employ the system of the present invention. Other uses of the system include: adding heat to confined spaces such as truck trailers or railroad tank cars containing solidified solids such as sulfur, asphalt, or other materials that were loaded into the transportation vehicle while molten and which must be liquefied for practical off loading. The system can also be used to add heat to confined storage areas, such as crude oil tanks, paraffin storage tanks, sulfur tanks, or other liquefiable materials such as thermoplastic polymers. Still further, the system can be used to add heat to an area to melt ice, provide an alternate method for stimulating production of oil wells that previously required hot oil injection treatments to stimulate or restore petroleum production due to paraffin or asphalt deposits minimizing recovery of the liquid fractions coming from the well, and provide for an alternative method for heating tar sands or shale oil deposits in situ. With low grade deposits, secondary liquids may have to be used to extract the melted petroleum products from their matrix rocks, the system of the present invention obviates this.

BRIEF DESCRIPTION OF THE DRAWING FIGURES

FIG. 1 is a circuit showing the use of MN-68 Ferrite embodying the present invention.

FIGS. 2 and 2A show Ferrite elements using MN-68 Ferrite.

DETAILED DESCRIPTION OF THE PREFERRED EMBODIMENT OF THE INVENTION

Figure 3:
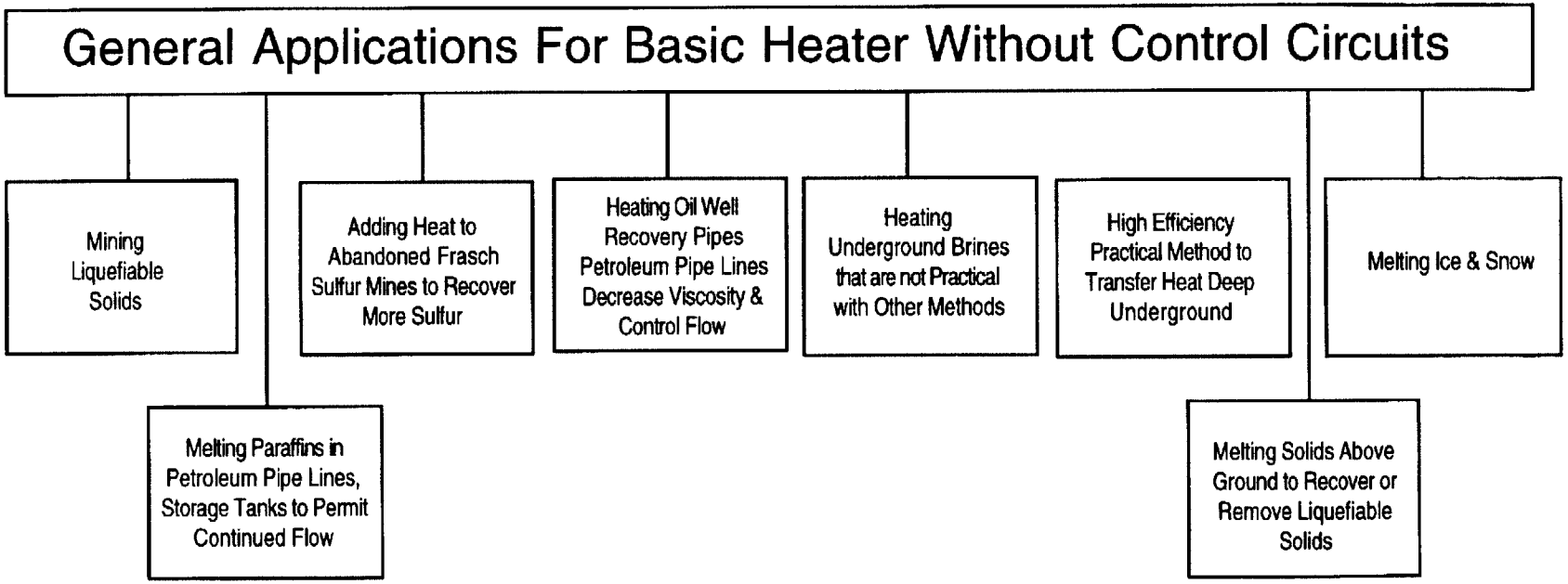
FIGS. 3 and 3A are block diagrams showing various applications of the circuit shown in FIG. 1.

Shown in FIG. 1 is a heating circuit 10 for converting RF energy into heat to be applied to another element. Circuit 10 consists entirely of an RF transmitter 12 and a Ferrite element 14 connected together by a cable 16. The impedance of the ferrite device matches the impedance of the RF transmitter. Therefore, there is no external impedance matching means in circuit 10. The preferred form of Ferrite element 14 includes a high Curie temperature, lossy soft ferrite material having a Curie temperature above 150° C., and preferably between 250° C. and 280° C., and as high as 400° C. and a cutoff frequency of about 10 KHz The most preferred form of ferrite has a formulation of $MnO_{0.45}Zn_{0.3}FeO_{0.25}Fe_2O_4$ as sold by Attenuation Technology, Inc. under the trademark MN-68. A conventional ham radio trainmaster can be used as transmitter 12. It is noted that a conventional AM radio station transmitter could also be used as long as the size of the ferrite heater is scaled up accordingly to safely handle the higher output of the larger AM transmitter. Conventional RG-8 or RG-11 RF coaxial cable can be used as cable 16, and a stainless steel case 18 can be used if necessary, depending on the application of system 10.

A single one-piece form of MN-68 Ferrite can include two coaxial cable receptacles molded into the device as is indicated in FIGS. 2 and 2A. Such a monolithic ferrite element is shown in FIG. 2 as element 14S, and does not require any internal or external wiring and can be formed into shapes such as rods, hollow cylinders, or other shapes optimized to ore holes in solids (once in place) and to heat surrounding masses of dielectric material. Hollow cylinders, such as element 14H shown in FIG. 2A, can be used to drain melted materials to receptacles for recovery of the liquified and purified material. Therefore, the ferrite can assume a cylindrical or tubular shape such as indicated in FIG. 2A. Alternative forms of the ferrite material are shown in FIGS. 6–9 of the incorporated patent. Still other shapes can be selected by molding and firing MN-68Ferrite, or its equivalent, into suitable shapes with suitable dimensions such as cylinders, hollow cylinders, flat slabs and the like. A finished ferrite element can be machined, turned, round or drilled with the proper power and machine tools. In this manner, the ferrite heating element can be formed into many different shapes to make the RF energy conversion heater of the present invention. The finished RF energy conversion heating element can be made to fit in many different places such as inside pipes, on outside surfaces of pipes, in meltable solids, on top of liquefiable solids, in underground water, in liquefiable solids and the like. Wound chokes can also be used, and suitable pins, such as pin P in element 14S, can be permanently installed to attach the cable to the ferrite. The pins can be hard wired in intimate contact with the ferrite device to minimize reflection of RF energy back to the RF transmitter. Alternatively, two leads from the coax cable can be placed into separate blind holes in the ferrite element, such as holes H in element 14H, in order to make the RF heater function. The properties of the ferrite element 14 are sufficient to close the RF circuit. The preferred form of the circuit 10 has cable 16 in electrical contact with ferrite element 14, preferably by having cable 16 skinned bare at the ferrite element. Therefore, the type of dielectric materials heated by the circuit 10 cannot be such that the current from generator 12 will be shorted by this dielectric material since there will be electrical contact between the cable 16 and the dielectric material via the ferrite element. However, it has been found that MN-68 will not short most RF generators for most known dielectric materials because the internal dc impedance of MN-68 is high enough to prevent such shorting.

Shown in FIG. 3 is a block diagram indicating some of the possible applications for circuit 10. Referring to FIG. 3, it can be understood that circuit 10 can be used to: liquify impure solids, such as: melt Frasch dome sulfur to extract it from newly discovered deposits as well as putting additional energy into underground sulfur deposits that were believed to be beyond economic recovery using prior art techniques, melt above ground blocks of sulfur in an effective and environmentally acceptable way, melt paraffin wax in such deposits to recover the liquefied and purified paraffin and leave the nonliquefiable materials behind, melt paraffin wax deposits in petroleum pipelines using either external heaters or internal heaters in the pipeline, control the temperature of crude materials such as crude molten sulfur or crude petroleum to melt solids already in situ (or to prevent them from forming, as the case may be) as they enter the pipeline or at selected points along a recovery pipe; add heat to large underground geologic formations, such as abandoned Frasch Sulfur Mines to recover and/or move sulfur; transport and position steam sufficient distances from a supply pipe to heat a sufficient volume to make a steam injection project worthwhile; heat underground brines that are not practical with prior methods; melt solids above ground to recover and/or remove liquefiable solids; melt ice and snow; melt paraffins in petroleum pipelines, storage tanks and the like to permit flow; heat oil well recovery pipes petroleum pipelines to decrease viscosity and to control flow; and transfer heat to an underground location in an efficient manner.

Figure 3A:
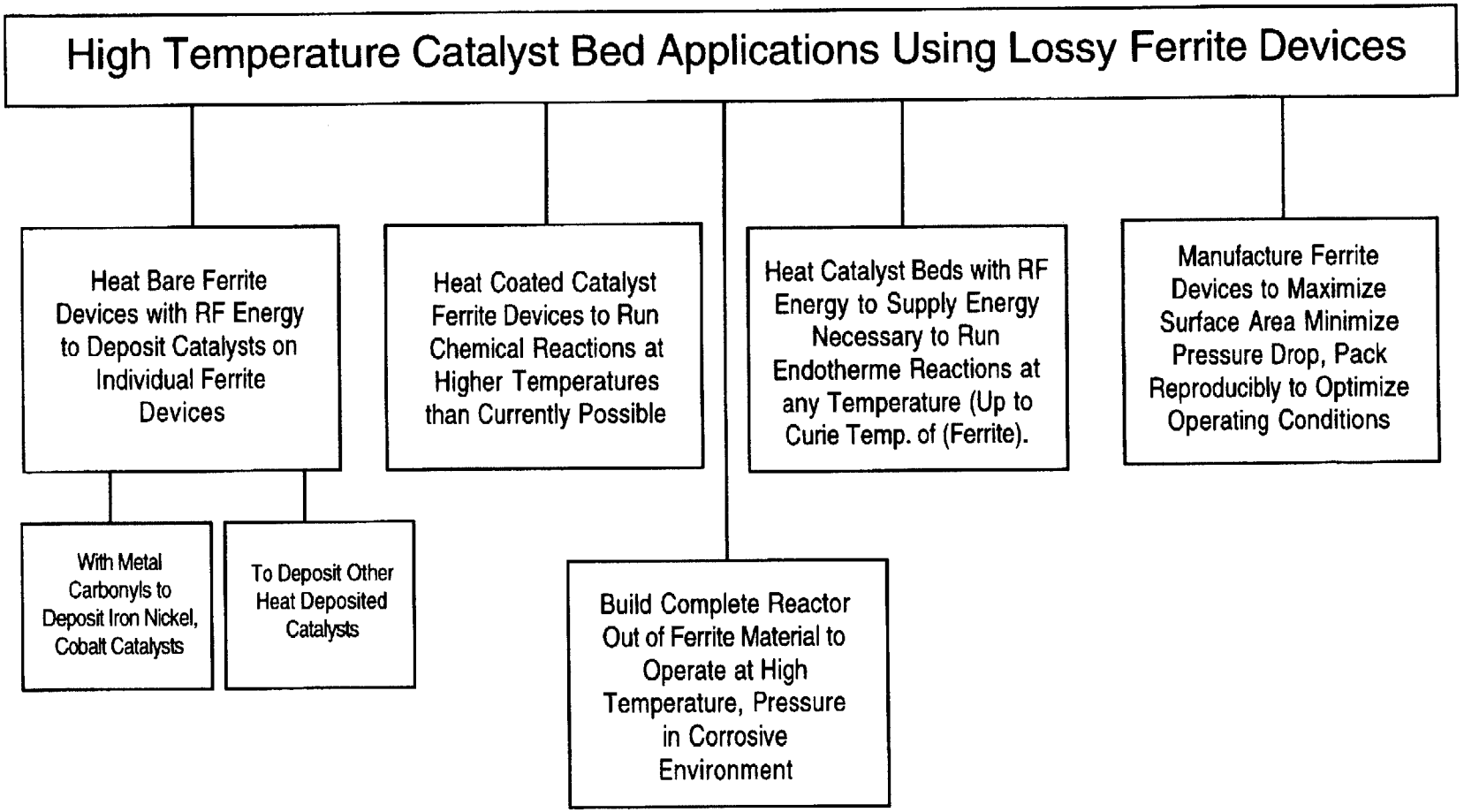

As mentioned above, the circuit shown in FIG. 1 can be used in catalyst bed applications as well. In such use, ferrite element 14 is shaped as suitable for such catalyst bed uses, as will occur to those skilled in the art based on the teaching of this disclosure. For example, ferrite element 14 can be channel shaped, cube shaped or the like as is necessary for the particular catalyst bed. As above, there are only three elements in circuit 10 as applied to a catalyst bed: RF transmitter 12, the catalyst bed (Ferrite element 14) and cable 14 connecting the transmitter to the ferrite element. No other elements, especially external control circuits, are present. FIG. 3A is a block diagram showing some of the possible applications for the circuit 10 in a catalyst bed. These uses include: heating bare ferrite devices with RF energy to deposit catalysts on individual ferrite devices, with a further use being to decompose metal carbonyls vapor to deposit catalytic surfaces of iron, nickel, cobalt or other heat deposited catalysts; heating coated catalyst ferrite devices to run and maintain chemical reactions at high temperatures (as compared to temperatures that can be used with presently-available catalyst beds), to temperatures of up to 280° C. and/or to 400° C.; heating coated catalyst beds with RF energy to supply the energy necessary to run endothermic reactions at any temperature up to the Curie temperature of the Ferrite; manufacture future ferrite devices to maximize surface area, minimize pressure drop, and pack reproducibly to optimize operating conditions; and to build a complete reactor out of ferrite material to operate at high temperature and pressure and in a corrosive environment.

It is understood that while certain forms of the present invention have been illustrated and described herein, it is not to be limited to the specific forms or arrangements of parts described and shown.

We claim:

1. A method of transferring heat in an underground mining operation to a location comprising:

A) providing a heating circuit consisting of an RF generator, a coaxial cable connected to said RF generator, and a high Curie Temperature self-regulating ferrite heating element with a Curie Temperature of at least 150° C. connected to the coaxial cable to receive RF energy from the RF generator;

B) placing the ferrite heating element in an underground deposit to be heated;

C) applying RF energy to the ferrite element; and

D) maintaining the ferrite heating element below its Curie Temperature.

2. The method defined in claim 1 wherein the ferrite element has a lower cutoff frequency of 10 Kilohertz.

3. The method defined in claim 2 wherein the ferrite element has a Curie temperature between 250° C. and 280° C.

4. The method defined in claim 3 wherein the ferrite element has a formulation of $MnO_{0.45}Zn_{0.3}FeO_{0.25}Fe_2O_4$.

5. The method defined in claim 1 further wherein said underground deposit is a mine.

6. The method defined in claim 1 further wherein said underground deposit is an abandoned Frasch Sulfur Mine to recover and move sulfur.

7. The method defined in claim 1 further wherein said underground deposit is underground brines.

8. The method defined in claim 1 further wherein said underground deposit includes paraffins.

9. The method defined in claim 1 further includes placing the ferrite element in an oil well recovery pipe located in said underground deposit to decrease the viscosity of the liquid in the pipe.

10. The method defined in claim 1 further wherein said underground deposit is in a deep underground location.

11. The method defined in claim 1 further wherein the Curie temperature is up to 280° C.

* * * * *